US006481125B1

(12) United States Patent
Pokrasoff

(10) Patent No.: US 6,481,125 B1
(45) Date of Patent: Nov. 19, 2002

(54) COMBINATION POSTCARD AND PEEL-OFF STICKER

(76) Inventor: Lawrence N. Pokrasoff, 5365 The Teledo No. 2, Belmont Shore, CA (US) 90803

( * ) Notice: Subject to any disclaimer, the term of this patent is extended or adjusted under 35 U.S.C. 154(b) by 0 days.

(21) Appl. No.: 09/894,267

(22) Filed: Jun. 29, 2001

(51) Int. Cl.[7] ..... B42D 15/02; G09F 1/00

(52) U.S. Cl. ..... 40/124.01; 40/124.191; 229/92.8

(58) Field of Search ..... 40/124.01, 124.191; 428/46; 229/92.8

(56) References Cited

U.S. PATENT DOCUMENTS 2,805,816 A * 9/1957 Morgan ..... 229/92.8
5,914,158 A * 6/1999 McGuiness ..... 229/92.8
5,916,650 A * 6/1999 Rosenbaum et al. ..... 40/702

* cited by examiner

*Primary Examiner*—Cassandra H. Davis
(74) *Attorney, Agent, or Firm*—Morland C. Fischer

(57) ABSTRACT

A combination postcard and peel-off sticker, wherein the postcard has a writing surface on one side thereof at which messages can be written to the addressee. An ornamental sheet on which a design, indicia or illustration is printed is adhesively bonded to the front of the postcard. A peel-off label is removably attached to and carried by the ornamental sheet at a clear film area thereof. The peel-off label includes a design, indicia or illustration which may be part of or independent from the design, indicia or illustration of the ornamental sheet. The sticker is peeled off the clear film area of the ornamental sheet and then attached to any suitable surface (e.g. a notebook) in order to capture and make visually accessible the emotions, expression and individuality of the sender as represented by the particular design, indicia or illustration that appears on the sticker.

6 Claims, 2 Drawing Sheets

COMBINATION POSTCARD AND PEEL-OFF STICKER

BACKGROUND OF THE INVENTION

1. Field of the Invention.

This invention relates to a postcard having a writing surface on one side thereof at which messages can be written by the sender and a peel-off sticker removably attached to the opposite side and bearing a decorative design, illustration or trendy words. The sticker can be removed from the postcard and affixed to another surface (e.g. a notebook, wall or automotive bumper) by which to capture and retain the emotions and expression of the sender as shown on the sticker.

2. Background Art.

Postcards have long been used to send brief written messages from a sender to a recipient. In some cases, the back of the postcard is blank save for the name and address of the recipient. A decorative picture is often printed on the front of the postcard. This decorative picture may be a person, place, scenic view, and the like. The precise form of the decorative picture is usually selected to convey the emotions and feelings of the sender to the recipient at the time during which the postcard is mailed. However, once the message has been read by the recipient, the postcard is usually discarded along with the decorative picture. Consequently, not only is the decorative picture lost, but there is no way for the recipient to capture, hold onto and have ready visual access to the personal statement that is being expressed by the sender of the postcard by way of the picture. In other words, without keeping and constantly carrying around the entire postcard, there is no readily available or convenient means for the recipient to continue his enjoyment of the sender's decorative picture and be frequently reminded of the personal emotions and feelings represented thereby.

SUMMARY OF THE INVENTION

In general terms, a combination postcard and peel-off sticker is described. On the back of the postcard is a writing surface at which a message can be written by the sender, the address of the recipient is entered, and a postage stamp is affixed. An ornamental sheet is adhesively bonded to the front of the postcard. A peel-off sticker having an adhesive backing is also bonded to the front of the postcard. The peel-off sticker is preferably carried by and removably attached to the ornamental sheet. The sticker is separated from the ornamental sheet by means of a continuous cut line that extends around the interface therebetween. Each of the ornamental sheet and the peel-off sticker contain one or more of a variety of decorative designs, illustrations, catchy words, trendy phrases, or the like, that express the emotions and individuality of the sender. The ornamentality of the peel-off sticker may be part of or independent from the ornamentality of the ornamental sheet.

After the postcard is received and the message that is written at the back of the postcard has been read by the recipient, he may then remove (i.e. pull-off) the sticker from the ornamental sheet at the front of the card. The sticker may then be affixed to any suitable surface (e.g. a notebook, wall or the bumper of a motor vehicle) so that the ornamentality of the sticker will be preserved and remain visually accessible to the recipient. Accordingly, the recipient will be able to continue enjoying the ornamentality of the sticker while being frequently reminded of the emotions and feelings of the sender that are captured thereby, even after the postcard to which the as attached is discarded.

DETAILED DESCRIPTION

Figure 1:
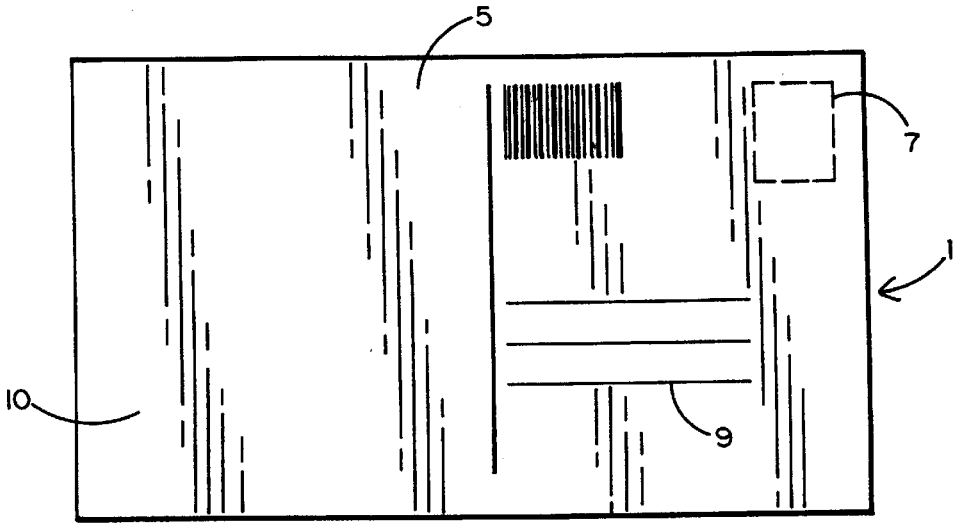
FIG. 1 illustrates an exploded view of the combination postcard and peel-off sticker which forms the present invention.
Figure 2:
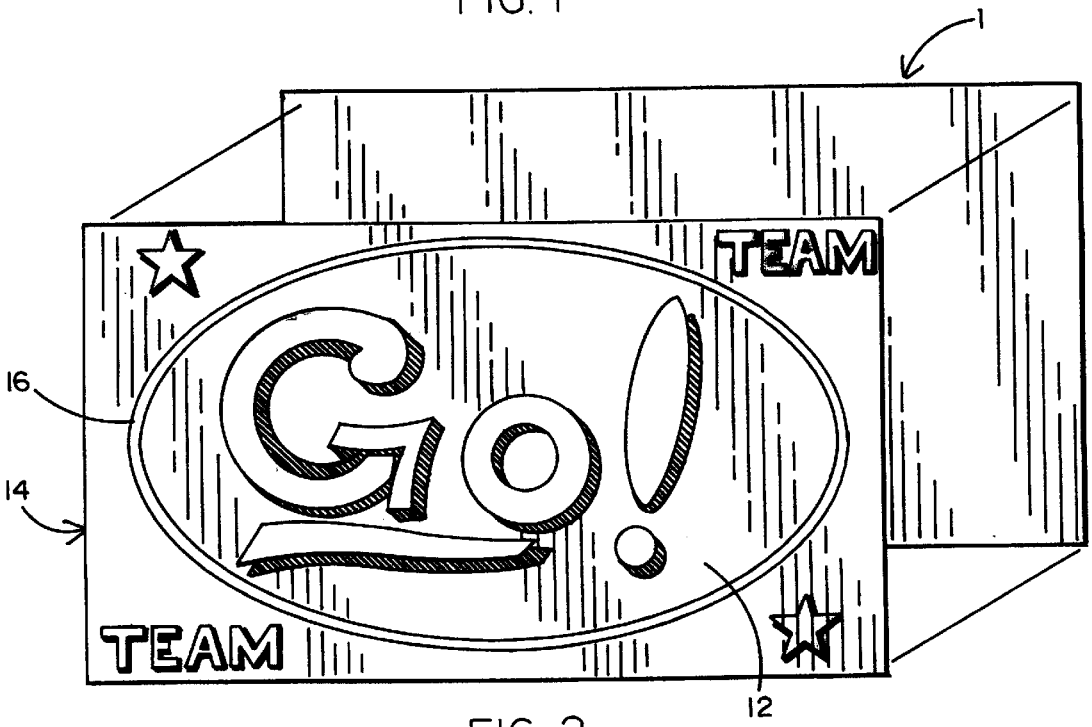
FIG. 2 shows the back of the postcard of FIG. 1 at which designated addressee, postage stamp and message areas are printed.
Figure 3:
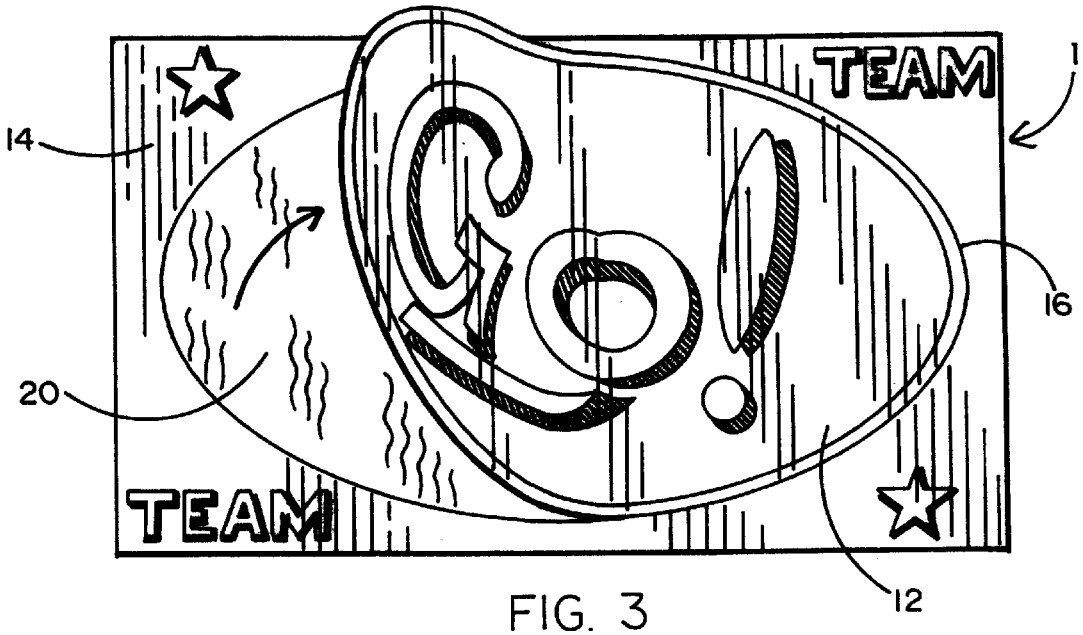
FIG. 3 illustrates the peel-off sticker being detached from an ornamental sheet and removed from the front of the postcard.
Figure 4:
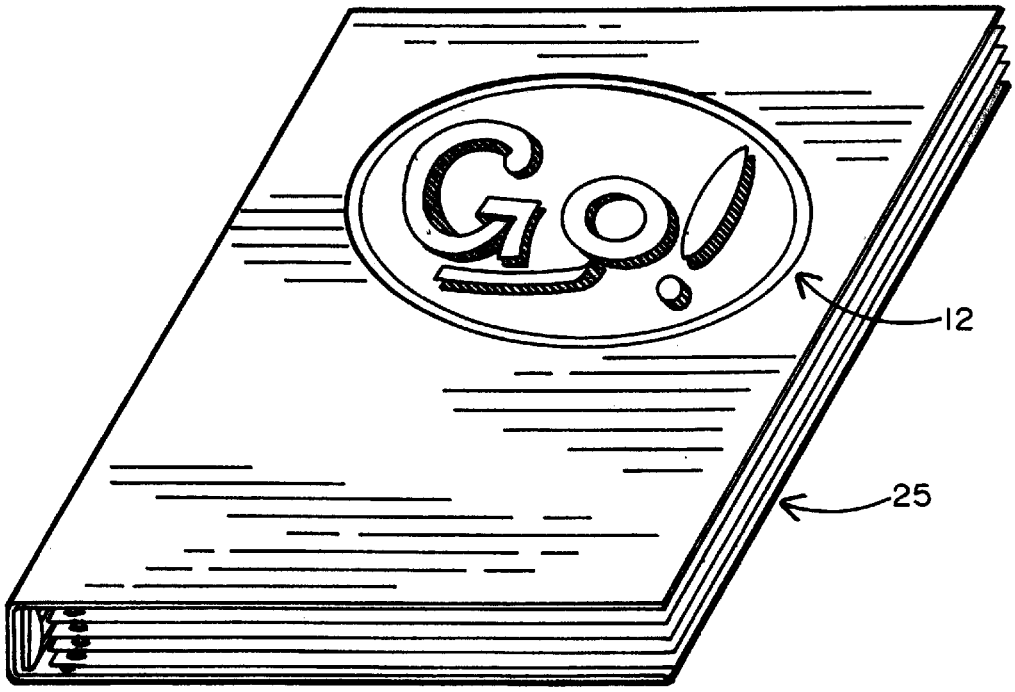
FIG. 4 illustrates the sticker adhesively bonded to a surface (e.g. a notebook) after the sticker has been detached from the ornamental sheet at the front of the postcard.

The combination postcard 1 and peel-off sticker 12 which forms the present invention is described in detail while referring concurrently to FIGS. 1–3 of the drawings. The postcard 1 is manufactured from a suitable paper card stock of the type that is common to a conventional postcard. As is best shown in FIG. 1, located on the back of the postcard 1 is the usual writing surface 5 having printed indicia that is also common to a conventional post card. Such printed indicia of the writing surface 5 typically includes a designated area 7 at which to affix a postage stamp. Below the area 7 designated for the placement of the postage stamp is a space 9 at which the user (i.e. sender) can write the name and address of the recipient if the postcard is to be sent through the mail. Opposite the locations 7 and 9 of the writing surface 5 at the back of the postcard 1 is a message area 10. The sender can write any message in the message area 10 that is intended to be conveyed to and read by the recipient.

As described above the writing surface 5 is printed on the back of the postcard 1. However, it is also within the scope of this invention to print the writing surface 5 on a separate sheet of paper (not shown) and then affix (e.g. adhesively bond) the sheet containing pre-printed stamp, address and message areas 7, 9 and 10 directly to the back of the postcard 1.

In accordance with the improvement of this invention, and referring specifically to FIGS. 2 and 3 of the drawings, there is shown a peel-off sticker 12 located on the front of the postcard 1. More particularly, the peel-off sticker 12 is associated with an ornamental sheet 14 that extends over the front of the postcard 1. The ornamental sheet 14 preferably contains any one or more of a variety of decorative designs, illustrations, catchy words, trendy phrases, or the like, which express the emotions and individuality of the sender. To this end, it will be possible for the sender to create a customized postcard by selecting a particular ornamental sheet 14 according to the taste of the sender. In other words, a variety of ornamental sheets 14 and peel-off stickers 12, all having different decorations and/or messages, can be manufactured. The sender simply picks the particular ornamental sheet that expresses his thoughts and attaches it to the front of the postcard.

The ornamentality of the peel-off sticker 12 may be part of or independent from the designs, illustrations or verbiage that covers the ornamental sheet 14. That is to say, the decorative designs, illustrations and words that are printed on the peel-off sticker can have a separate theme or be integrated with and blended to the surrounding ornamental features that are printed on the ornamental sheet 14. By way of example, the peel-off sticker 12 is shown in the drawings as being positioned at the center of the ornamental sheet 14 and surrounded by the ornamentalilty thereof. However, the precise location, size and decorative content of the ornamental sheet 14 and the peel-off sticker 12 associated therewith are not to be considered as limitations of this invention.

In order to remove the peel-off sticker 12 from the ornamental sheet 14 at the front of the postcard 1, a seam 16 is established at the interface between sticker 12 and sheet 14. In one case, a perforated line extends around the periphery of the sticker 12, such that the sticker 12 is torn off the ornamental sheet 14. In another case, the seam 16 is a continuous cut line that extends around the periphery of the sticker 12, whereby the sticker 12 is simply peeled off the ornamental sheet.

The peel-off sticker 14 has an adhesive backing to enable it to be both removably attached to the ornamental sheet 14 and reliably affixed to any suitable surface of the recipient's choice after the sticker 14 has been removed from the ornamental sheet 14 at the front of the postcard 1. So that the ornamental sheet 12 which carries the sticker 14 can be bonded face-to-face with the front of the postcard 1, the postcard should have a smooth, clean face. It is preferable that the ornamental sheet 14 that is to be bonded to the front of the postcard 1 have a smooth and low friction area 20 (best shown in FIG. 3) to which the sticker 12 is removably attached. Such smooth, low friction area 20 of the ornamental sheet 14 is typically manufactured from wax paper or similar thin film material that permits a release and peeling away of the sticker 12 from the sheet 14 at the continuous cut line 16 that extends around the periphery of sticker 12 in response to a pulling force applied thereto. Of course, as described above, the sticker 12 may also be torn from the sheet 14 along a perforated line.

After the recipient reads the sender's message on the writing surface 5 at the back of the postcard 1 and the sticker 12 is removed from the ornamental sheet 14 at the front of the postcard, the sticker 14 can then be attached to a surface such as a notebook 25, the wall of a room, the bumper of a motor vehicle, etc. Therefore, it may be appreciated that by virtue of this improvement, the use and continued enjoyment of the sticker and the ornamentality printed thereon need not be lost even after the sender's written message has been read and understood. Accordingly, the sender may mail or give the combination postcard 1 and peel-off sticker 12 to a friend, relative or colleague so as to convey both the written message on the writing surface 5 as well as an indication of the emotions and feelings of the sender as captured by the ornamental nature of the peel-off sticker 12. In this same regard, the removable sticker 12 is capable of surviving the disposal of the postcard whereby to enable the recipient to have ready visual access to the sender's originality and be frequently reminded of the emotions and feelings represented thereby. Thus, the sticker 12 which is carried on and removable from the postcard 1 has independent utility in and of itself once it is removed from the ornamental sheet 14 by the recipient.

I claim:

1. In combination:

a postcard having a back and a front, and information printed on the back regarding the affixation of a postage stamp, the identity of the addressee, and an area at which a message to the addressee can be written;

an ornamental sheet having a design, indicia or illustration printed thereon, said ornamental sheet being fixedly attached to the front of said postcard; and a sticker removably attached to the ornamental sheet at the front of the postcard and bearing a design, indicia or illustration, said sticker adapted to be removed from the ornamental sheet at the front of the postcard and then attached to a surface at which the design, indicia or illustration of said sticker will be visually accessible, said ornamental sheet having a clear film area, said sticker being removably attached to said ornamental sheet at said clear film area so as to be surrounded by the design, indicia or illustration of said ornamental sheet.

2. The combination recited in claim 1, wherein said sticker has an adhesive backing by which said sticker is first removably attached to the clear film area of said ornamental sheet at the front of said postcard and then attached to said surface after said sticker is removed from said ornamental sheet.

3. The combination recited in claim 1, wherein said ornamental sheet is adhesively bonded to the front of said postcard.

4. The combination recited in claim 1, wherein the design, indicia or illustration on said sticker blends together with and is part of the design, indicia or illustration printed on said ornamental sheet.

5. The combination recited in claim 1, wherein said sticker is separated from said ornamental sheet along a continuous cut line running between said sticker and said ornamental sheet, whereby said sticker is peeled off the clear film area of said ornamental sheet at said cut line.

6. The combination recited in claim 1, wherein said sticker is detachably connected to said ornamental sheet along a perforated line running between said sticker and said ornamental sheet, whereby said sticker is pulled-off the clear film area of said ornamental sheet by tearing said perforated line.

* * * * *